United States Patent [19]

Hammelmann

[11] 4,401,415

[45] Aug. 30, 1983

[54] HYDRAULIC PRESSURE TRANSFORMER

[76] Inventor: Paul Hammelmann, Zum Sundern 17, 4740 Oelde 1, Fed. Rep. of Germany

[21] Appl. No.: 253,146

[22] Filed: Apr. 10, 1981

[30] Foreign Application Priority Data

Apr. 16, 1980 [DE] Fed. Rep. of Germany ..... 3014552

[51] Int. Cl.[3] ..... F04B 1/18; F04B 17/00; F04B 35/00

[52] U.S. Cl. ..... 417/270; 417/457

[58] Field of Search ..... 417/269, 271; 91/502

[56] References Cited

U.S. PATENT DOCUMENTS

| | | | |
|---|---|---|---|
| 1,052,569 | 2/1913 | Cherry | 417/269 |
| 1,364,508 | 1/1921 | Moody | 91/507 |
| 1,554,628 | 9/1925 | Froelich | 417/269 |
| 2,027,076 | 1/1936 | Volliman | 417/269 |
| 2,531,202 | 11/1950 | Deschamps | 417/269 |
| 2,845,030 | 7/1958 | Le Febvre | 91/502 |
| 2,935,952 | 5/1960 | Rose | 417/271 |
| 3,405,641 | 10/1968 | Coberly | 417/271 |
| 4,168,652 | 9/1979 | Bick | 91/502 |
| 4,173,435 | 11/1979 | Hammelmann | 417/457 |

FOREIGN PATENT DOCUMENTS

| | | | |
|---|---|---|---|
| 593962 | 3/1960 | Canada | 417/269 |
| 818607 | 9/1951 | Fed. Rep. of Germany | 91/507 |

*Primary Examiner*—William L. Freeh
*Attorney, Agent, or Firm*—Michael J. Striker

[57] ABSTRACT

A pressure transformer including at least three driving pistons coupled to driven plungersby means of piston rods; to ensure a fixed staggered position of the piston rods during the entire operation of the transformer, a tubular shaft supporting an inclined wobble disk is arranged for rotation in the driving part between respective piston rods; a peripheral groove on the wobble disk engages pushing rollers mounted for rotation on respective piston rods and additional rollers are mounted on the opposite side of the piston rods to engage a straight guiding groove in the housing of the driving part to secure the piston rods against rotation about their axes.

10 Claims, 3 Drawing Figures

HYDRAULIC PRESSURE TRANSFORMER

BACKGROUND OF THE INVENTION

The present invention relates in general to hydraulic pressure transformers, and in particular to a hydraulically driven axial piston pump of the type having a first part including an intake port, a discharge port and a set of at least three hydraulically driven cylinder-and-piston units each defining a control opening for admitting and releasing a driving liquid, a second part containing a discharge chamber connectable to a consumer, a suction chamber for a driven medium, a set of plungers arranged in the suction chamber, suction valves and pressure valves arranged in the second part and cooperating with respective plungers, and piston rods connecting the pistons in the cylinder-and-piston units to the plungers.

SUMMARY OF THE INVENTION

A general object of the present invention is to provide an improved hydraulic pressure transformer of the above-described type in which the mutual shift of respective plungers is held constant during the entire operation of the device.

Another object of the invention is to provide a device of the aforedescribed type which is simple in structure.

An additional object of the invention is to provide such an improved pressure transformer in which a head piece in the secondary part of this transformer is under constant pressure load so that any load variations which might bring about fatigue failure are eliminated.

In keeping with these objects, and with others which will become apparent hereafter, one feature of the invention resides, in a hydraulic pressure transformer of the above described type, in a combination which comprises means for preventing rotation of each piston rod, a rotary tubular shaft arranged in the first or driving part of the transformer parallel to the piston rods and communicating with the intake port, a wobble disk attached at an oblique angle to the tubular shaft and having on its periphery a guiding groove, a pushing element projecting from each piston rod into engagement with the guiding groove to rotate the shaft during axial movement of the piston rod, a distributing segment attached to the rotary shaft in the range of the control openings of the cylinder-and-piston units and defining passages for periodically connecting the control opening to the intake port or to the discharge port.

In the construction according to this invention the head piece in the driven part of the transformer is loaded during the whole operational time of the transformer, inasmuch as at any time point at least one plunger performs a feeding stroke. By the action of the wobble disk which couples together all piston rods and thus all plungers which are mounted on the rods, the mutual axial shift of the plungers in any working position thereof is kept unchanged. The shift is selected such that during all operational phases at least one plunger performs an upward stroke.

As mentioned before, due to the continuous load of the head piece of the pressure transformer during each time point of its operation, load variations which in prior art constructions have caused fatigue failures, are eliminated.

Since the coupling between the piston rods is effected by means of a wobble disk which is fixed on a rotary tubular shaft through which pressure oil used as the driving medium for the cylinder-and-piston units flows and to which the piston rods are coupled, a very simple structure assembled only of a small number of component parts having a long working life, is achieved. Working pressure range of the pressure transformer according to this invention lies between 100 and 4000 bars.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
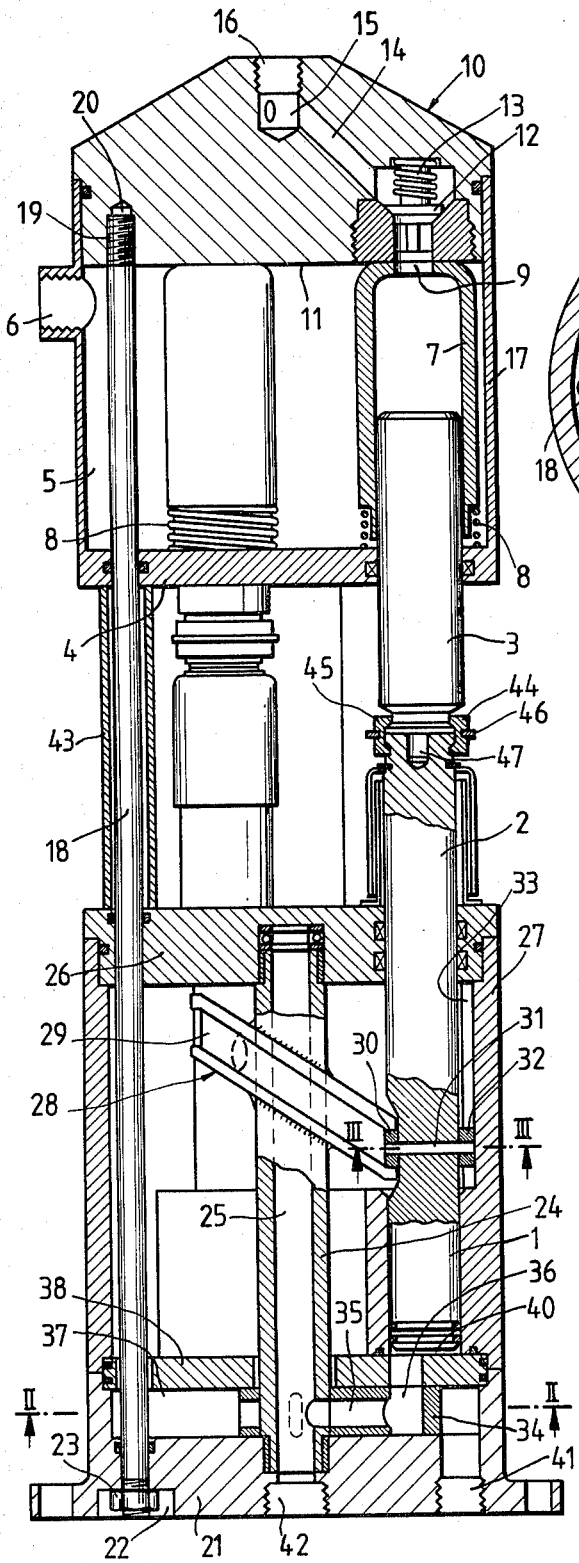
FIG. 1 is a longitudinal cross-section of the pressure transformer according to this invention.

The pressure transformer illustrated in the drawing is constituted by a driving part having three cylinder-and-piston units hydraulically driven by a pressure oil and each including a piston 1 connected via a piston rod 2 to a plunger 3 in the driven part of the transformer. The plunger slidably projects through openings in a bottom plate 4 into a suction chamber 5 into which a medium to be delivered, such as water for example, is fed through an intake port 6.

Suction valves in the driven part are in the form of sleeves 7 supported on pressure springs 8 which rest on the bottom plate 4 around the bores for respective plungers and urge the sleeves upwardly against the top surface 11 of suction chamber 5. Plungers 3 slidably engage the inner walls of respective sleeves 7 so that during the downward stroke of the plunger the sleeves due to frictional forces between the plunger and the inner wall and due to vacuum created above the plungers, is displaced downwardly against the spring 8 and disengages the top surface 11. As a consequence, water accumulated in suction space 5 is sucked into sleeve 7 through the top opening 9.

During the upward stroke of plunger 3, sleeve 7 is again brought into engagement with the top surface 11 and plunger 3 exerts pressure against water column in sleeve 7. Within a head piece 10, the bottom of which forms the top surface 11 of the suction chamber 5, there are arranged pressure valves 12 the seats of which are in alignment with the top opening 9 of respective sleeves 7. Pressure valve 12 is biased by a pressure spring 13 into its seat. When pressure of fluid medium in the sleeve 7 exceeds the biasing force of spring 13, valve 12 opens and driven medium (water) is discharged via a channel 14 into a storage space 15 which communicates via a discharge port 16 with a consumer.

The head piece 10 closes the cylindrical wall 17 of the suction chamber 5 and is firmly attached thereto by means of tie bolts 18 extending over the entire length of the pressure transformer. Tie bolts 18 have threaded end portions 19 screwed into corresponding threaded holes 20 in head piece 10 and opposite threaded end of each bolt 18 terminates in a recess 22 in a bottom plate 21 of the transformer, being tightened thereto by a nut 23. The tie rods or bolts pass through tubular spacers 43 arranged between the driving and driven parts of the transformer, and all housing parts are tied together by the set of tie bolts 18.

Cylindrical housing 27 of the driving part is closed at its upper end by a partition 26 and at its lower end by the end plate 21. A rotary tubular shaft 24 defining an axial passage 25 is journalled at its ends in bearings formed in the partition 26 and the end plate 21. The axis of rotation of the shaft 24 is parallel to the longitudinal axes of respective piston rods 2. Partition 26 is formed with sealed bores for slidably guiding the piston rods. A wobble disk 28 is secured at an oblique angle to shaft 24 and is formed on its circumference with a guiding groove 29 which cooperates with driving rollers 30 mounted on respective rods 2. Each driving roller 30 is mounted for rotation on a fixed pin 31 passing through the piston rod and forming a right angle with its axis. The opposite projecting end of pin 31 supports for rotation another roller 32 which is guided in an axially directed elongated groove 33 formed in the cylindrical wall 27 of the driving part. In this manner, piston rods 2 are secured against rotation about their axes. By means of the inclined guiding groove 28 on the wobble disk 29 and the driving rollers 30, respective piston, piston rod and plunger assemblies are coupled together at preset axially staggered positions determined by the inclination of wobble disk 29 and this axially shifted position is maintained in any operational phase of the pressure transformer. During an upward stroke of piston 1, pushing rollers 30 exert a force against the lateral rims of the guiding groove 28, and consequently a rotary movement is continuously applied to the shaft 24.

Figure 2:
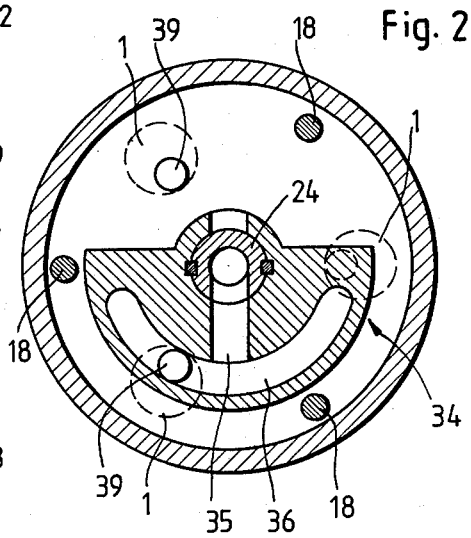
FIG. 2 is a transverse section taken along the line II—II in FIG. 1.
Figure 3:
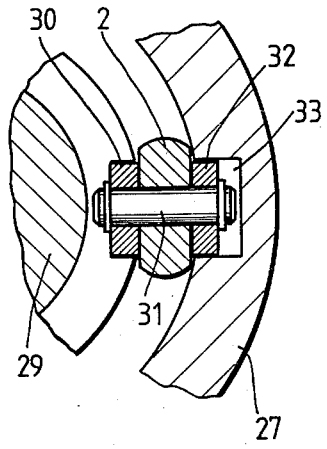
FIG. 3 is a transverse sectional view taken along the line III—III in FIG. 1 and shown on an enlarged scale.

A distributing segment 34 is attached to the lower end of shaft 24 and, as seen from FIG. 2, the segment is formed with a distributing channel 36 having the shape of a circular section, and with a radial connecting channel 35 communicating through the interior of shaft 24 with the intake port 42. Distributing segment 34 rotates in a chamber 37 bounded by an intermediate partition 38 and the end plate 21. The intermediate partition 38 is provided with openings 39 forming the control openings for admitting and releasing driving liquid into the cylinders 40 forming with the pistons 1 the driving cylinder-and-piston units. During rotation of shaft 24, the arcuate distribution channel 36 periodically connects and disconnects the control openings 39 to and from the intake port 42 for the hydraulic oil. Space 37 further communicates with a discharge port 41 located outside the range of movement of distributing segment 34. Driving pressure oil is fed through intake port 42 into the interior of rotary shaft 24 and reaches through connection channel 35 the distributing channel 36. As depicted in FIG. 2, the arcuate distributing channel 36 is always in communication with one of the control openings 38 so that pressure oil is admitted into the corresponding cylinder-and-piston unit 40 and piston 1 is attached by pressure oil. It can also be seen from FIG. 2 that one of the control openings 39 is always separated from the arcuate distributing channel 36 and the third control opening in the illustrated position is covered by the distributing segment immediately before establishing communication with the distributing channel 36. In this position of the third control opening, the corresponding piston has attained its lower dead point.

The control openings uncovered by of the semi-circular distributing segment 34 communicate via the space 37 with the discharge port 41. For driving the pressure transformer in this example, a flow of 100 liters per minute of working oil at a pressure of 360 bars is employed.

The driven part is fastened to the driving part by means of the aforementioned spacer tubes 43 resting on the partition 26 and the tie bolts 18 passing through the spacer tubes.

Plungers 3 are linked to the ends of piston rods 2 in such a manner as to be easily exchangeable. For this purpose, there are employed two connecting half shells 44 and 45 fastened one to the other by a snap ring 46 so as to create a positive connection between the flanged end portions of piston rod 2 and the plunger 3. In addition, plunger 3 is provided at its lower face with a projecting pin 47 fitting into a corresponding recess in the upper face of piston rod 2.

In this exemplary embodiment, the diameter of piston 1 corresponds to the diameter of plunger 3. It is of course possible to make use of different relations of the diameters of respective component parts. For instance, the plunger diameter can be either smaller or larger than that of the piston 1 and the corresponding modification of the illustrated design is made exclusively in the range of the suction chamber 5.

It will be understood that each of the elements described above, or two or more together, may also find a useful application in other types of constructions differing from the types described above.

While the invention has been illustrated and described as embodied in a specific example of the pressure transformer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulically driven axial piston pump of the type having a driving part including at least three cylinder-and-piston units, a driven part including a suction chamber provided with suction valves and pressure valves for a driven medium, at least three plungers arranged in alignment with respective pistons of the cylinder-and-piston units and being coupled thereto by means of piston rods, said plungers cooperating with said suction valves and said pressure valves to suck or discharge a driven medium into and from said suction chamber, said driving part comprising a first end plate arranged in the range of said piston rods and being provided with guiding openings for said piston rods, a second end plate arranged in axially spaced relationship to said first end plate and being provided with a central intake port and with an eccentric discharge port for admitting and releasing a driving medium, and an intermediate partition arranged between said end plates and defining with said second end plate an interspace, said intermediate partition being formed with a center opening and with eccentric openings communicating with respective cylinder-and-piston units, a rotary tubular member passing through the center opening of said intermediate partition and being supported for rotation between the two end plates, said tubular member defining an axial bore communicating with the central intake port said second end plate, a wobble disk rigidly secured at an oblique angle to said rotary tubular member and being slidably coupled to said pistons rods to impart a reciprocating movement to said pistons and to said plungers, a distributing segment attached to said rotary tubular member to rotate in said interspace, said segment being formed with channels communicating with the axial bore of said tubular member and with the eccentric openings of said intermediate partition for periodically connecting said cylinder-and-piston units to the intake port or to the discharge port in said second end plate.

2. An axial piston pump as defined in claim 1, wherein said channels in said distributing segment include a curved recess having the form of a circular section orbiting in the range of said openings in the intermediate partitions, and a radial channels connecting said curved recess with the axial bore in said tubular member.

3. An axial piston pump as defined in claim 1, wherein the discharge port for the driving medium communicates with said interspace, said discharge port being situated outside the range of movement of said distributing segment.

4. An axial piston pump as defined in claim 1, wherein said driving part includes a housing jacket connected to the two end plates, said rotary tubular member being journalled in corresponding recesses in said end plates.

5. An axial piston pump as defined in claim 4, wherein said driven part includes a housing jacket enclosing said suction chamber, a bottom plate facing said first end plate of the driving part and being supported on tubular spacers, the outer end of said housing jacket of said first part being closed by a head piece accommodating a pressure valve and a discharge chamber for the driven medium, and tie bolts extending from said head piece through said tubular spacers into the second end plate of the housing of said driving part.

6. An axial piston pump as defined in claim 5, wherein said plungers project through openings provided in the facing end plates of the housing of said driving and driven parts.

7. An axial piston pump as defined in claim 6, wherein said plungers are disconnectably attached to said piston rods in the region between said facing end plates of said housings.

8. An axial piston pump as defined in claim 1, wherein said wobble disk is provided on its periphery with a guiding groove, and each of said piston rods being provided with pushing elements slidably engaging said peripheral groove.

9. An axial piston pump as defined in claim 8, wherein said pushing element is a roller supported for rotation on a pin passing through the corresponding piston rod at right angles to the axis of rotation of said tubular shaft, said roller engaging said peripheral groove of said wobble disk.

10. An axial piston pump as defined in claim 9, wherein said means for preventing rotation of the piston rod includes a straight guiding groove directed parallel to the axis of an assigned piston, and an additional roller mounted for rotation on the opposite end of said pin and engaging said straight groove.

* * * * *